US005339987A

United States Patent [19]

D'Andrade

[11] Patent Number: 5,339,987

[45] Date of Patent: Aug. 23, 1994

[54] CONTROLLED FLOW, BURSTING WATER GUN RELEASE MECHANISM

[76] Inventor: Bruce M. D'Andrade, 3 Ten Eyck Rd., Whitehouse Station, N.J. 08889

[21] Appl. No.: 82,735

[22] Filed: Jun. 28, 1993

[51] Int. Cl.[5] ..... A63H 33/18

[52] U.S. Cl. ..... 222/79; 222/509; 222/518; 222/401

[58] Field of Search ..... 222/79, 401, 175, 511–518, 222/510, 509, 400.8, 400.7; 42/54; 446/473

[56] References Cited

U.S. PATENT DOCUMENTS

| | | | |
|---|---|---|---|
| 1,795,684 | 3/1931 | Seele | 222/518 X |
| 2,808,178 | 10/1957 | Di Grado et al. | 222/518 X |
| 2,892,576 | 6/1959 | Ward | 222/518 X |
| 3,005,577 | 10/1961 | Webster | 222/518 X |
| 3,197,070 | 7/1965 | Pearl et al. . | |
| 3,396,876 | 8/1968 | Workman et al. | 222/518 X |
| 3,416,710 | 12/1968 | Roubol | 222/518 X |
| 3,578,789 | 5/1971 | Ferri . | |
| 3,580,863 | 5/1971 | Campbell | 222/518 X |
| 4,214,674 | 7/1980 | Jones et al. . | |
| 4,239,129 | 12/1980 | Esposito . | |
| 4,271,986 | 6/1981 | Stecker | 222/518 X |
| 4,286,737 | 9/1981 | Gallant | 222/518 X |
| 4,413,972 | 11/1983 | Lawson | 222/518 X |
| 4,735,239 | 4/1988 | Salmon et al. . | |
| 4,854,480 | 8/1989 | Shindo . | |
| 4,964,547 | 10/1990 | Ling | 222/321 X |
| 5,074,437 | 12/1991 | D'Andrade et al. . | |
| 5,150,819 | 9/1992 | Johnson et al. . | |

*Primary Examiner*—Kevin P. Shaver

*Assistant Examiner*—Kenneth DeRosa

*Attorney, Agent, or Firm*—Kenneth P. Glynn

[57] ABSTRACT

The present invention involves a water gun having at least one pressurizable air/water storage tank, a pressurizing mechanism, a channel of release for shooting water and a release mechanism. The improvement lies in the particular release mechanism of the water gun. This release mechanism is for controlled flow with bursting release of water. It includes a plug valve which is located within a channel of release. The release mechanism has a first spring connected to the plug valve which biases the plug valve to its first, closed position. This first spring and the internal water pressure against the plug valve constitutes the "first force." Linkage connects a trigger to the plug valve such that activation of the trigger provides a second force which moves the linkage so as to move the plug valve from the first, closed position to the second, opened position and release of the trigger permits the first force to bias the plug valve back to its first, closed position. There is also a delay spring located within the linkage itself. When the trigger is pulled, it pulls the delay spring in a direction opposite from an against the first force. This first force is the force of the first spring as well as the internal water pressure holding the valve closed. At some point, the delay spring overcomes the forces of the first force holding the valve closed. At this point, the valve snaps open and there is rapid decrease of water pressure causing a burst of water to exit the water gun. This creates a controllable burst and a realistic trigger release.

20 Claims, 2 Drawing Sheets

CONTROLLED FLOW, BURSTING WATER GUN RELEASE MECHANISM

BACKGROUND OF THE INVENTION

1. Field of the Invention

The present invention is directed toward a toy water squirt gun, and more particularly to such toy water squirt guns that use a self-contained pumping means to pressurize air in an air/water tank. The water is then released in a selective manner, e.g. through a nozzle, causing the stored water to be propelled forward in a narrow stream. Specifically, the present invention involves a controlled flow, bursting water gun release mechanism.

2. Information Disclosure Statement

Water guns have for decades been a very popular child's toy. Since the toy industry is very competitive, hundreds of different style water guns have been developed in an attempt to profit from the toys inherent popularity. The most traditional forms of water guns are activated by a pumping action, either manually through the trigger or automatically through a battery operated motor. Such pump action water guns work, but the guns are limited in the distance the water travelled, the amount of water projected and the duration of the pumping cycle. In an attempt to improve upon water guns the toy industry has developed pressure activated water guns. Such pressure water guns work upon the principle of pressure differentials between the water held within the toy and the atmosphere. The water within the toy is held at a pressure higher than that of the ambient air. As a result, when the water within the toy is given a channel of release, the water will stream out under the pressure. The present invention involves an improved release mechanism for such guns.

Prior art that shows pressure differential types of water guns are exemplified by the following:

U.S. Pat. No. 3,197,070 to Curtis F. Pearl et al, shows a water gun activated by trapping water in a collapsible area. As the device is collapsed, the pressure of the water builds, spraying the water out of the one small orifice left within the pressured volume. Once the confined volume is fully collapsed, the re-expansion of the volume draws forth more water from a reservoir, thus priming the water gun for another cycle. The water being pressurized is limited to the volume of the collapsible volume. However, the Pearl invention does not involve the release mechanism herein.

U.S. Pat. No. 4,854,480 to Robert S. Shindo and U.S. Pat. No. 4,735,239 to Michael E. Salmon et al, both show toy water devices that use an elastic bladder to pressurize water. The bladders are filled with high pressure water, and the bladders respond by elastically deforming. The source of pressurized water is then removed and the water within the expanded bladder is held in place by a clamping device activated by a trigger. The water gun is used by selectively releasing the water from the expanded bladder.

Water guns have also been developed that use air pressure to pressurize water and force water through squirt channels. Such toys that use air pumps to pressurize water are exemplified by the following:

U.S. Pat. No. 4,214,674 to Jones et al, shows a two-piece apparatus consisting of a pressurized water reservoir and a discharging gun. Air is introduced into the water reservoir via a hand operated pump. The air pressurizes the water, forcing it up through the discharging gun, where the rate of discharge can be regulated by a trigger. However, again, the present invention release mechanism is neither taught nor suggested.

U.S. Pat. No. 4,239,129 to Gary F. Esposito describes a water pistol and/or flashlight structure which includes a reciprocal pump within the gun housing. The pump is used to pressurize air within the tank after water has been added, and a trigger is used for subsequent release of the water. Battery operated lights and sound are also provided.

U.S. Pat. No. 3,578,789, issued to Giampiero Ferri, describes a water pistol which includes a main liquid reservoir and a pressurized liquid reservoir contained within the main liquid reservoir. A trigger-actuated pump is used with a manually operated three way valve to selectively supply liquid: (a) from the pump to the pressurized reservoir; (b) from the pump to the nozzle and to the pressurized liquid reservoir; or, (c) from the pump to both the pressurized liquid reservoir and nozzle.

U.S. Pat. Nos. 5,074,437 and 5,150,819 issued to Johnson and D'Andrade describe single tank and double tank pump up pressurized tank water guns which are commercially known as "Super Soakers" (trademark of Larami Corporation, Philadelphia Pa.) and have experienced substantial commercial success due to their ability to project streams of water over unusual distances and for extended time periods.

Notwithstanding the prior art, the present invention release mechanism is neither taught nor rendered obvious.

SUMMARY OF THE INVENTION

The present invention involves a water gun having a housing, a barrel, at least one pressurizable air/water storage tank, a pressurizing mechanism, a channel of release for shooting water and a release mechanism. The improvement lies in the particular release mechanism of the water gun. This release mechanism is for controlled flow with bursting release of water. It includes a plug valve which is located within a channel of release and the plug valve has a first, closed position which prevents flow of water out of the channel of release and has a second, opened position which permits flow of water out of the channel of release. The release mechanism also has a first spring connected to the plug valve which biases the plug valve to its first, closed position. This first spring and the internal water pressure against the plug valve constitutes the "first force". There is also a trigger connected to the housing and has a portion extending from the housing to permit manual activation thereof. Linkage connects the trigger to the plug valve such that activation of the trigger provides a second force which moves the linkage so as to move the plug valve from the first, closed position to the second, opened position and release of the trigger permits the first force to bias the plug valve back to its first, closed position. There is also a delay spring located within the linkage itself. When the trigger is pulled, it pulls the delay spring in a direction opposite from and against the first force. This first force is the force of the first spring as well as the internal water pressure holding the valve closed. At some point, the delay spring overcomes the forces of the first force holding the valve closed. At this point, the valve snaps open and there is rapid decrease of water pressure causing a burst of water to exit the water gun. The reverse occurs when the delay spring can no longer overcome the internal pressure and the valve snaps closed. This creates a controllable burst and a realistic trigger release.

BRIEF DESCRIPTION OF THE DRAWINGS

The invention will be more fully understood by referring to the following detailed specifications, the above specification and the claims set forth herein, when taken in connection with the drawings appended hereto, wherein:

DETAILED DESCRIPTION OF THE PRESENT INVENTION

Figure 1:
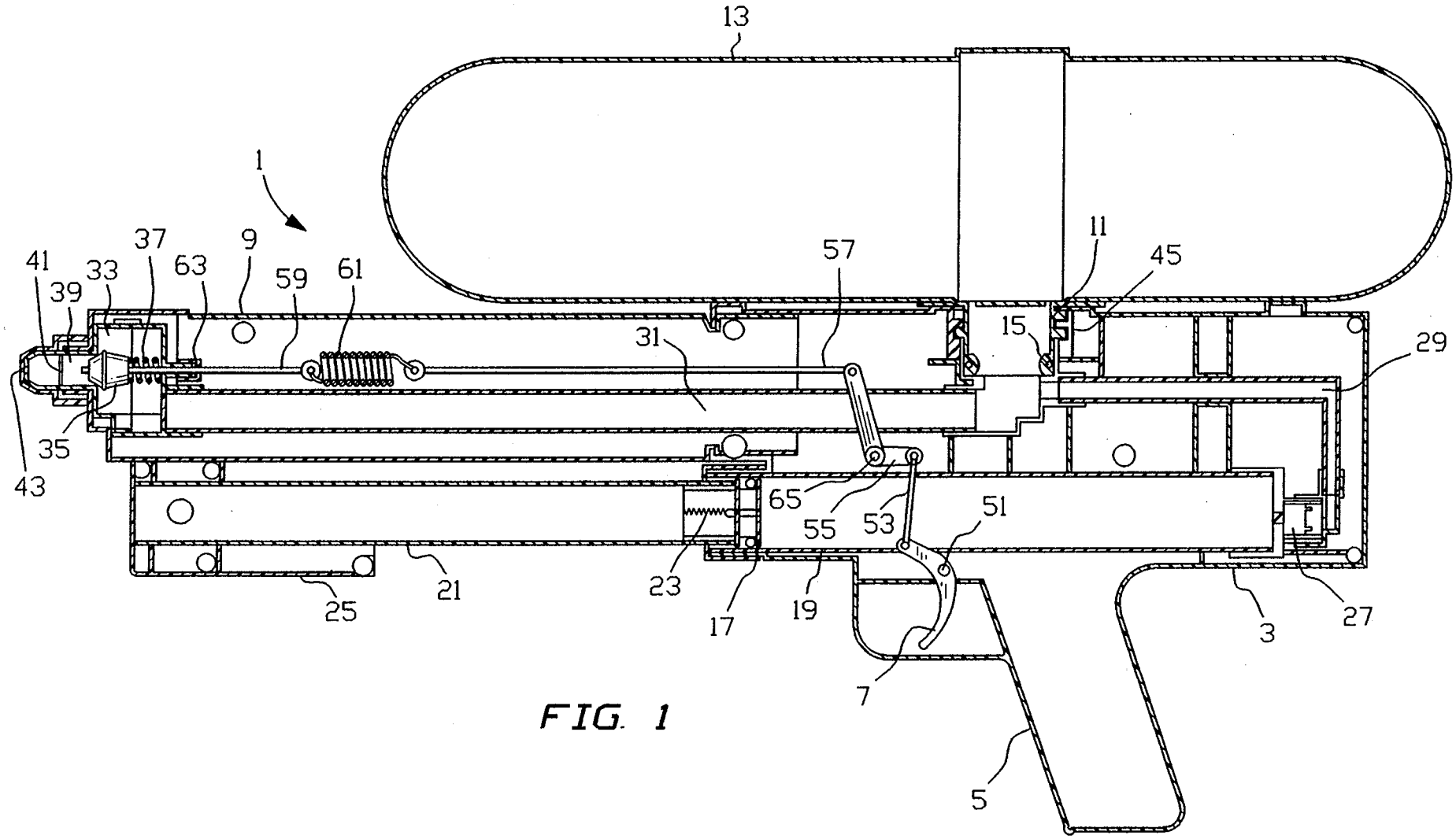
FIG. 1 shows a side cut view of one preferred embodiment to the present invention; and, FIG. 2 shows a side cut view of another embodiment of the present invention.

The present invention is, as mentioned, directed toward a toy water gun that uses a pump, e.g. an electrically operated or manually operated pump to draw and pressurize water and air, storing the water and air under pressure until selectively discharged. The science of pressurized water toys is not new, and over the years many different designs have been developed utilizing a pumping action to pressurize water. As applied to the art of toy water squirt guns, the most common type of device involves a two-stroke pump, wherein the pump draws water into a chamber through a large orifice during the priming stroke, and forces water out of the chamber through a very narrow orifice during the compression stroke. This simple system forms the basis of thousands of devices in addition to water guns, such as non-aerosol dispensing devices for hair spray, perfume, window cleaner, and countless other products that are dispensed in a narrow stream or mist.

The problem with simple two-stroke squirting systems is that the amount of fluid that can be expelled is limited to a single volume of the compressible area; also, the pressure of the liquid exiting the device is dependent directly upon the force being applied during the time of expulsion. Consequently, when water is squirted in this manner, only a small volume is released with each pumping action. When attempts are made to increase the amount of water propelled by increasing the volume of the compressible area, the pumping action cannot displace the water at a high pressure, resulting in expulsion of water at low pressures.

Water guns need the characteristics of squirting a large volume of water at high pressures. Generally speaking, the higher the pressure, the longer the distance the water can be propelled, thus increasing the range and power of the water gun. As a result, the invention herein, in conjunction with another inventor, developed pressured water guns as exemplified by U.S. Pat. No. 5,151,819, entitled "Double Tank Pinch Trigger Pump Water Gun", to Lonnie G. Johnson and Bruce M. D'Andrade on Sep. 29, 1992, incorporated herein by reference in its entirety, as well as U.S. Pat. No. 5,074,437, entitled "Pinch Trigger Pump Water Gun", to Bruce M. D'Andrade and Lonnie G. Johnson on Dec. 24, 1991, also incorporated herein by reference in its entirety.

The present invention release mechanism is advantageously used for any type of pressurized water gun to create a substantially full force initial release of water for shooting and may be used with low pressure, medium pressure and high pressure water guns. Low pressure water guns are those which operate above ambient pressure but below 40 psi. Medium pressure water guns operate in the range of about 40 to 70 psi and high pressure water guns operate at pressures above 70 psi. One type of low pressure water gun in which the present invention is particularly useful involves nearly laminar flow type of water squirting and this involves a burst of water with a larger diameter nozzle than the higher pressure water guns. Such water guns are operated in the 20 to 40 psi range. However, the particular pressure of the water gun in which the present invention release mechanism may be employed is not critical, as long as it is somehow pressurized. Thus, it could be used in a manually operated water gun or a battery or electric operated water gun.

Referring now to FIG. 1 there is shown a present invention water gun 1 which includes housing 3. This main housing is shown with its essential components and, as is the entire figure, is illustrated in a side cut view. There is a handle 5 extending from housing 3 with a trigger 7. There is also an extending barrel 9 and an air/water pressurizable storage tank 13 with male protrusion bayonet attachment component 11. Thus, tank 13 is rotated and then lifted out in a bayonet type fashion in this embodiment, but may be attached by a snap lock or by a threaded neck or otherwise, or could be permanently attached with an inlet port and cap for adding water to tank 13.

Male protrusion component 11 includes a ring seal 15 and is connected to female receiving collar 45.

There is a pressurizing piston 17 which is attached to piston rod 21 and is located within chamber 19. Slider 25 is attached to piston rod 21 and in a movable fashion moves forward and rearward relative to extended barrel 9. There is a pressure release spring valve 23 which prevents overpressurization of the water gun. When slider handle 25 is reciprocated, air pressure builds up within the water gun until a predesired pressure is reached and then spring valve 23 will release excess pressure. One way valve 27 permits air to be forced into but not to be returned from chamber 19.

When tank 31 is removed from main housing 3 and partially filled with water, for example, half to three-quarters filled with water, it is then returned to main housing 3 by the user by inverting the water gun 1 and attaching the tank to the water gun. Then slider handle 25 is reciprocated and pressure is built up. Note that when the gun 1 is uprighted, the water from tank 13 will, at least in part, seek its lowest level through gravity and, therefore, fill up conduit 29, channel of release 31, including wider portion 33, as well as the open area within female receiving portion 45 of the connection. Thus air pressure will build up in the top of air/water pressurizable storage tank 13 and will put pressure on the water within gun 1.

Trigger 7 has a pivot attachment 51 and extends below main housing 3 so that it may be manually activated. Its inside portion is connected to linkage 53 which is likewise connected to arm 55 which has a pivot point 65. This is connected to linkage 57 which is connected also to linkage 59 via spring 61. This spring 61 is a direct part of the linkage has predetermined strength and extensions so that it operates to create a burst of flow. Linkage 59 is connected to plug valve 35 which seals off the channel of release to prevent water from leaving the water gun and first spring 37 biases plug valve 35 to its first, closed position. It has a second, opened position to the right of the drawing when first spring 37 is compressed. When a user has pressurized gun 1 with water contained therein, when trigger 7 is pulled, the linkage extends second spring 61 so that it extends to a predetermined length and, at that point, overcomes the strength of the first force, i.e., the internal water pressure and the first spring 37 to rapidly move plug valve 35 from its first, closed position to its second, opened position, thereby allowing a burst of water to flow out of the gun. When trigger 7 is released, spring 37 again closes plug valve 35.

Although not required, in this embodiment, due to a large nozzle opening 43, e.g., ⅛ inch diameter, screen 41 is included in the front portion 39 of the channel of release beyond plug valve 35 so as to eliminate a substantial part of the turbulence and create laminar flow, or near laminar flow as possible.

A critical feature of the invention involves the use of two forces operating in opposite directions whereby the first force consists of both a realistically light spring biasing the plug valve closed and water pressure. The larger part of the first force is the water pressure holding the valve closed. A second force is provided by trigger pressure and delay spring to have adequate strength beyond a certain point of extension to overcome the first force, thereby opening the valve in a snap action.

Figure 2:
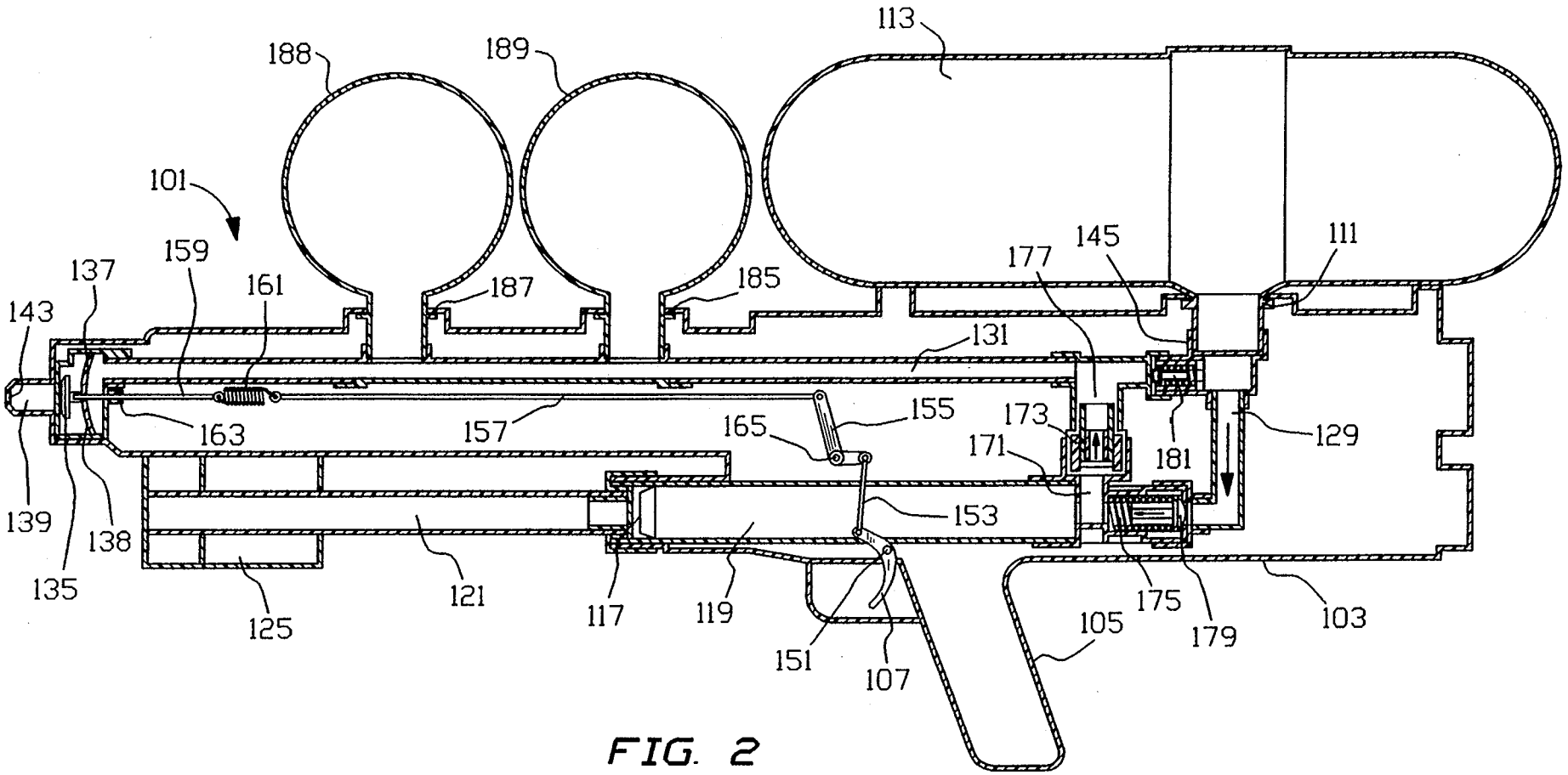

FIG. 2 shows a side cut view of an alternative present invention water gun 101 which includes main housing 103. There is a handle 105 extending from housing 103 with a trigger 107. there is also an extended barrel 109, a water storage tank 113 and two air/water pressurizable storage tanks 188 and 189. Tank 113 is attached to housing 103 with male protrusion bayonet attachment component 111 and tanks 188 and 189 are permanently attached. Tank 113 is rotated and then lifted out in a bayonet type fashion in this embodiment. Male protrusion component 111 includes a ring seal 115 and is connected to female receiving collar 145.

There is a pressurizing piston 117 which is attached to piston rod 121 and is located within chamber 119. Slider handle 125 is attached to piston rod 121 and in a movable fashion moves forward and rearward relative to extended barrel 109.

When tank 113 is removed from main housing 103 and partially filled with water, for example, half to three-quarters filled with water, it is then returned to main housing 103 by the user by inverting the water gun 101 and attaching the tank 113 to the water gun. Then slider handle 125 is reciprocated and pressure is built up. Note that when the gun 101 is uprighted, the water from tank 113 will, at least in part, seek its lowest level through gravity and, therefore, fill up conduit 129, but not channel of release 131, due to valve 181. When slider handle 125 moves towards trigger 107, piston 117 pushes air into conduit 171 and past one way valve 173 to conduit 177, down channel of release 131 to plug valve 135 and also into tanks 188 and 189 via tank inlets 185 and 187. When slider handle 125 is pushed away form the trigger area, one way valve 179 is pulled open and water form conduit 129 is pumped therefrom past one way valve 173 and into conduit 177, channel of release 131 and tanks 188 and 189. Thus, air and water are pumped into the aforesaid areas and the air is pressured.

Trigger 107 has a pivot attachment 151 and extends below main housing 103 so that it may be manually activated. Its inside portion is connected to linkage 153 which is likewise connected to arm 155 which has a pivot point 165. This is connected also to linkage and has predetermined strength and extensions so that it operates to create a burst of flow. Linkage 159 is connected to plug valve 135 which seals off the channel of release 131 to prevent water from leaving the water gun, and compression spring 137-138 biases plug valve 135 to its first, closed position. It has a second, opened position to the right of the drawing when compression spring 137-138 is compressed. When a user has pressurized gun 101 with water contained therein, when trigger 107 is pulled, the linkage extends second spring 161 so that it extends to a predetermined length and, at that point, overcomes the strength of leaf spring 137-138 and the internal water pressure holding the valve closed to rapidly move plug valve 135 from its first, closed position to its second, opened position, thereby allowing a burst of water to flow out of the gun. When trigger 107 is released, spring 137-138 again closes plug valve 135.

Obviously, numerous modifications and variations of the present invention are possible in light of the above teachings. For example, although the invention herein is described in the drawings as utilizing a plug valve, it should be noted that any type of valve which would have the equivalent effect, i.e., rapidly open in response to a delayed spring double force mechanism, could be used. For example, plunger valves, butterfly valves or valves using a rack and pinion where the rack is attached to the linkage and has a delayed, rapid activation could be used. It is therefore understood that within the scope of the appended claims, the invention may be practiced otherwise than as specifically described herein.

What is claimed is:

1. In a water gun having a housing, a barrel, at least one pressurizable air/water storage tank, a pressurizing mechanism, a channel of release for shooting water, and a release mechanism, the improvement which comprises:

a controlled flow, bursting water gun release mechanism, including:

(a) a valve located within said channel of release and having a first, closed position which prevents flow of water out of said channel of release and having a second, opened position which permits flow of water out of said channel of release;

(b) a first spring connected to said valve and biasing said valve to its first, closed position;

(c) a trigger connected to said housing, and having a portion extending from the housing to permit manual activation thereof;

(d) linkage connected to said trigger and to said valve such that activation of said trigger moves said linkage so as to move said valve from said first, closed position to said second, opened position and release of said trigger permits said first spring to bias said valve back to its first, closed position.

(e) a delay spring functioning as part of said linkage and located on said linkage between said valve and said trigger whereby when said trigger is activated, the force of the delay spring must be overcome before said valve will open causing a bursting of water to exit said water gun.

2. The water gun of claim 1 wherein said delay spring has a first range of extension whereby the first spring biasing said valve to its first, closed position is not overcome, and a second range of extension beyond said first range of extension whereby the first spring is overcome and said valve is moved from its first, closed position to its second, opened position.

3. The water gun of claim 1 wherein said channel of release has a predetermined cross-sectional area and has an outlet section downstream from said valve, and said outlet section includes an orifice which has a cross-sectional area less than the predetermined cross-sectional area of said channel of release.

4. The water gun of claim 1 wherein said channel of release includes a turbulence-reducing screen.

5. The water gun of claim 4 wherein said turbulence-reducing screen is located within the outlet section between said valve and said orifice.

6. The water gun of claim 1 wherein said linkage includes two tie rods with said delay spring located therebetween.

7. The water gun of claim 1 wherein said storage tank comprises one tank and includes a manual pressurizing pump with a pressure release valve to prevent excessive pressure.

8. The water gun of claim 7 wherein said gun is a high pressure water gun and said pressure release valve activates at pressures of 90 to 100 psi.

9. The water gun of claim 7 wherein said gun is a low pressure water gun and said pressure release valve activates at pressures of 40 to 50 psi.

10. The water gun of claim 7 wherein said gun is a laminar flow, very low pressure water gun and said pressure release valve activates at pressures of 20 to 40 psi.

11. In a multiple tank water gun having a housing, a barrel, at least one pressurizable air/water tank, at least one air/water storage tank, a pressurizing mechanism a channel of release for shooting water and a release mechanism, the improvement which comprises:

a controlled flow, bursting water gun release mechanism, including:

(a) a valve located within said channel of release and having a first, closed position which prevents flow of water out of said channel of release and having a second, opened position which permits flow of water out of said channel of release;

(b) a first spring connected to said valve and biasing said valve to its first, open position;

(c) a trigger connected to said housing, and having a portion extending from the housing to permit manual activation thereof;

(d) linkage connected to said trigger and to said valve such that activation of said trigger moves said linkage so as to move said valve from said first, closed position to said second, opened position and release of said trigger permits said first spring to bias said valve back to its first, closed position; and, (e) a delay spring functioning as part of said linkage and located on said linkage between said valve and said trigger whereby when said trigger is activated, the force of the delay spring must be overcome before said valve will open causing a burst of water to exit said water gun.

12. The multiple tank water gun of claim 11 wherein said delay spring has a first range of extension whereby the first spring biasing said valve to its first, closed position is not overcome, a second range of extension beyond said first range of extension whereby the first spring is overcome and said valve is moved from its first, closed position to its second, opened position.

13. The multiple tank water gun of claim 11 wherein said channel of release has a predetermined cross-sectional area and has an outlet section downstream from said valve, and said outlet section includes an orifice which has a cross-sectional area less than the predetermined cross-sectional area of said channel of release.

14. The multiple tank water gun of claim 11 wherein said channel of release includes a turbulence-reducing screen.

15. The multiple tank water gun of claim 14 wherein said turbulence-reducing screen is located within the outlet section between said valve and said orifice.

16. The multiple tank water gun of claim 11 wherein said linkage two tie rods with said delay spring located therebetween.

17. The multiple tank water gun of claim 11 wherein said storage tank comprises one tank and includes a manual pressurizing pump for pressurizing said pressurizable air/water tank.

18. The multiple tank water gun of claim 17 wherein said manual pressuring pump is capable of pumping water from said storage tank to said pressurizable air/-water tank, thereby increasing water within said tank to decrease air volume, thereby increasing air pressure.

19. The multiple tank water gun of claim 17 wherein said gun further includes a pressure release valve to prevent pressurization of said at least one pressurizable air/water tank above a predetermined pressure.

20. The multiple tank water gun of claim 18 wherein said gun further includes a pressure release valve to prevent pressurization of said at least one pressurizable air/water tank above a predetermined pressure, said pressure release valve being connected to said storage tank so as to re-channel water pumped from said storage tank back to said storage tank when said predetermined pressure.

* * * * *

US005339987B1

REEXAMINATION CERTIFICATE (4190th)

United States Patent [19] [11] B1 5,339,987

D'Andrade [45] Certificate Issued Oct. 31, 2000

[54] CONTROLLED FLOW, BURSTING WATER GUN RELEASE MECHANISM

[75] Inventor: Bruce M. D'Andrade, 3 Ten Eyck Rd., Whitehouse Station, N.J. 08889

[73] Assignee: Bruce M. D'Andrade, Whitehouse Station, N.J.

Reexamination Request:
No. 90/004,477, Dec. 5, 1996

Reexamination Certificate for:

| | |
|---|---|
| Patent No.: | **5,339,987** |
| Issued: | **Aug. 23, 1994** |
| Appl. No.: | **08/082,735** |
| Filed: | **Jun. 28, 1993** |

[51] Int. Cl.[7] ..... A63H 33/18

[52] U.S. Cl. ..... 222/79; 222/509; 222/518; 222/401

[58] Field of Search ..... 222/79, 401, 175, 222/511–518, 510, 509, 400.8, 400.7; 42/54; 446/473

[56] References Cited

U.S. PATENT DOCUMENTS

| | | | |
|---|---|---|---|
| 2,249,608 | 7/1941 | Greene | 222/79 |
| 3,116,855 | 1/1964 | Thomson | 222/207 |
| 5,074,437 | 12/1991 | D'Andrade et al. | 222/79 |

*Primary Examiner*—Joseph A. Kaufman

[57] ABSTRACT

The present invention involves a water gun having at least one pressurizable air/water storage tank, a pressurizing mechanism, a channel of release for shooting water and a release mechanism. The improvement lies in the particular release mechanism of the water gun. This release mechanism is for controlled flow with bursting release of water. It includes a plug valve which is located within a channel of release. The release mechanism has a first spring connected to the plug valve which biases the plug valve to its first, closed position. The first spring and the internal water pressure against the plug valve constitutes the "first force." Linkage connects a trigger to the plug valve such that activation of the trigger provides a second force which moves the linkage so as to move the plug valve from the first, closed position to the second, opened position and release of the trigger permits the first force to bias the plug valve back to its first, closed position. There is also a delay spring located within the linkage itself. When the trigger is pulled, it pulls the delay spring in a direction opposite from an against the first force. This first force is the force of the first spring as well as the internal water pressure holding the valve closed. At some point, the delay spring overcomes the forces of the first force holding the valve closed. At this point, the valve snaps open and there is rapid decrease of water pressure causing a burst of water to exit the water gun. This creates a controllable burst and a realistic trigger release.

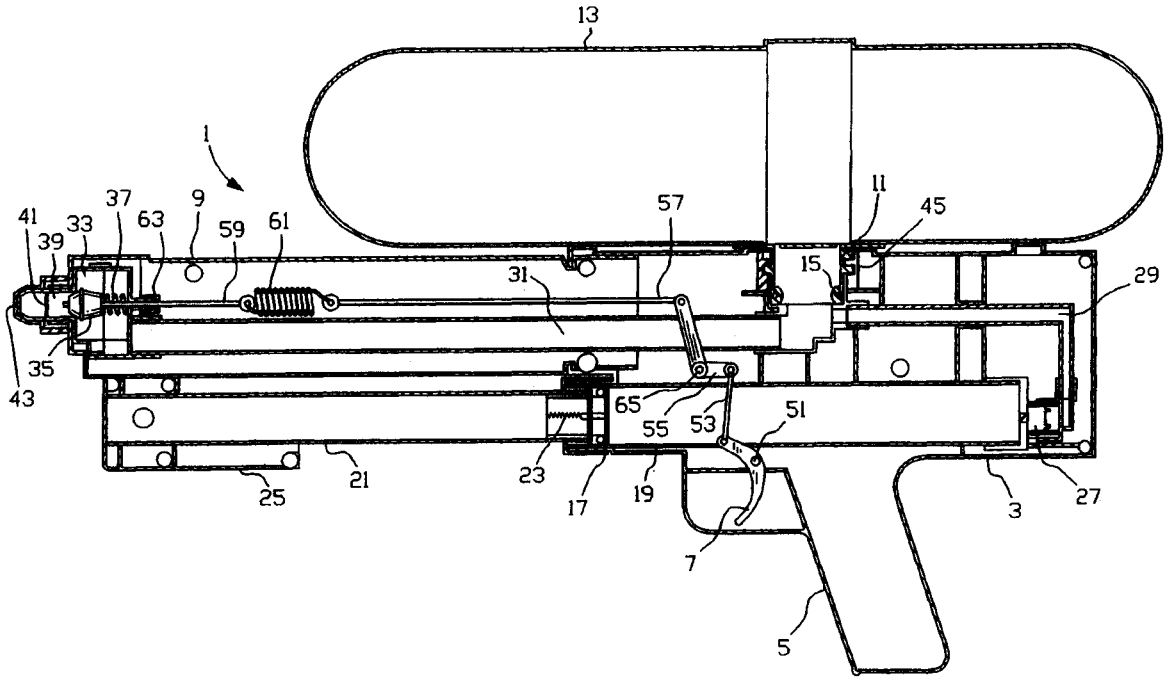

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 11 are determined to be patentable as amended.

Claims 2–10 and 12–20, dependent on an amended claim, are determined to be patentable.

1. In a water gun having a housing, a barrel, at least one pressurizable air/water storage tank, a pressurizing mechanism, a channel of release for shooting water, and a release mechanism, the improvement which comprises:

a controlled flow, bursting water gun release mechanism, including:

(a) a valve located within said channel of release and having a first, closed position which prevents flow of water out of said channel of release and having a second, opened position which permits flow of water out of said channel of release*, said valve being configured such that pressurized water within said channel of release creates a water pressure closing force on said valve*;

(b) a first spring connected to said valve [and] *having a first spring force for* biasing said valve to its first, closed position*, said first spring force and the water pressure closing force creating a first force*;

(c) a trigger connected to said housing, and having a portion extending from the housing to permit manual activation thereof;

(d) *a* linkage connected to said trigger and to said valve such that activation of said trigger moves said linkage so as to move said valve from said first, closed position to said second, opened position and release of said trigger permits said first spring to bias said valve back to [its] *the* first, closed position[.]*; and*

(e) a delay spring functioning as part of said linkage and located on said linkage between said valve and said trigger whereby when said trigger is activated, the force of the delay spring must be overcome *by a user displacing said trigger a predetermined distance such that a second force is generated by said delay spring opposite to the first force upon displacement of said trigger* before said valve will open*, and upon displacement of said trigger said predetermined distance, the second force overcomes the first force to displace said valve from the closed position such that the water pressure closing force equalizes, causing said valve to rapidly move to said second, opened position* causing a bursting of water to exit said water gun.

11. In a multiple tank water gun having a housing, a barrel, at least one pressurizable air/water tank, at least one air/water storage tank, a pressurizing mechanism, a channel of release for shooting water, and a release mechanism, the improvement which comprises:

a controlled flow, bursting water gun release mechanism, including:

(a) a valve located within said channel of release and having a first, closed position which prevents flow of water out of said channel of release and having a second, opened position which permits flow of water out of said channel of release*, said valve being configured such that pressurized water within said channel of release creates a water pressure closing force on said valve*;

(b) a first spring connected to said valve [and] *having a first spring force for* biasing said valve to its first, [open] *closed* position*, said first spring and water pressure closing forces creating a first force*;

(c) a trigger connected to said housing, and having a portion extending from the housing to permit manual activation thereof;

(d) *a* linkage connected to said trigger and to said valve such that activation of said trigger moves said linkage so as to move said valve from said first, closed position to said second, opened position and release of said trigger permits said first spring to bias said valve back to [its] *the* first, closed position; and (e) a delay spring functioning as part of said linkage and located on said linkage between said valve and said trigger whereby when said trigger is activated, the force of the delay spring must be overcome *by a user displacing said trigger a predetermined distance such that a second force is generated by said delay spring opposite to the first force upon displacement of said trigger* before said valve will open*, and upon displacement of said trigger said predetermined distance, the second force overcomes the first force to displace said valve from the closed position such that the water pressure closing force equalizes, causing said valve to rapidly move to said second, opened position* causing a burst of water to exit said water gun.

* * * * *